US006433665B2

(12) United States Patent
Huang et al.

(10) Patent No.: US 6,433,665 B2
(45) Date of Patent: Aug. 13, 2002

(54) HIGH EFFICIENCY THIN FILM INDUCTOR

(75) Inventors: Kuo-Ching Huang, Kaohsiung; Jin Yuan Lee; Tse-Liang Ying, both of Hsin-chu, all of (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 09/839,702

(22) Filed: Apr. 23, 2001

Related U.S. Application Data

(62) Division of application No. 09/359,892, filed on Jul. 26, 1999, now Pat. No. 6,278,352.

(51) Int. Cl.[7] ..... H01F 5/00
(52) U.S. Cl. ..... 336/200; 336/232; 336/223
(58) Field of Search ..... 336/200, 223, 336/232; 29/602.1

(56) References Cited

U.S. PATENT DOCUMENTS 4,626,816 A * 12/1986 Blumkin et al. ..... 336/192
5,370,766 A 12/1994 Desaigoudar et al. ..... 156/643
5,373,112 A * 12/1994 Kamimura et al. ..... 174/255
5,450,263 A 9/1995 Desaigoudar et al. ..... 360/110
5,532,667 A * 7/1996 Haertling et al. ..... 336/117
5,539,241 A 7/1996 Abidi et al. ..... 257/531
5,863,806 A 1/1999 Lue ..... 428/3

* cited by examiner

*Primary Examiner*—Anh Mai
(74) *Attorney, Agent, or Firm*—George O. Saile; Stephen B. Ackerman

(57) ABSTRACT

An improved thin film inductor design is described. A spiral geometry is used to which has been added a core of high permeability material located at the center of the spiral. If the high permeability material is a conductor, care must be taken to avoid any contact between the core and the spiral. If a dielectric ferromagnetic material is used, this constraint is removed from the design. Several other embodiments are shown in which, in addition to the high permeability core, provide low reluctance paths for the structure. In one case this takes the form of a frame of ferromagnetic material surrounding the spiral while in a second case it has the form of a hollow square located directly above the spiral.

6 Claims, 4 Drawing Sheets

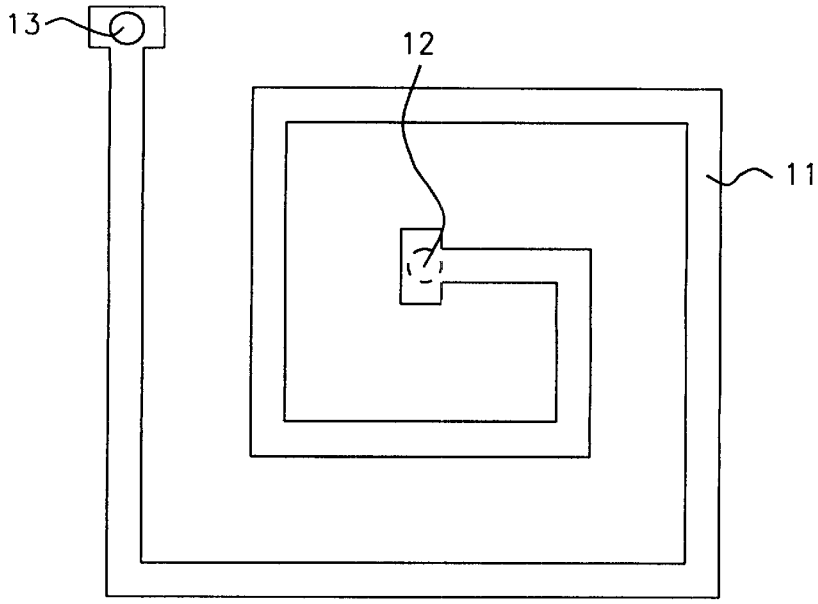
FIG. 1a – Prior Art
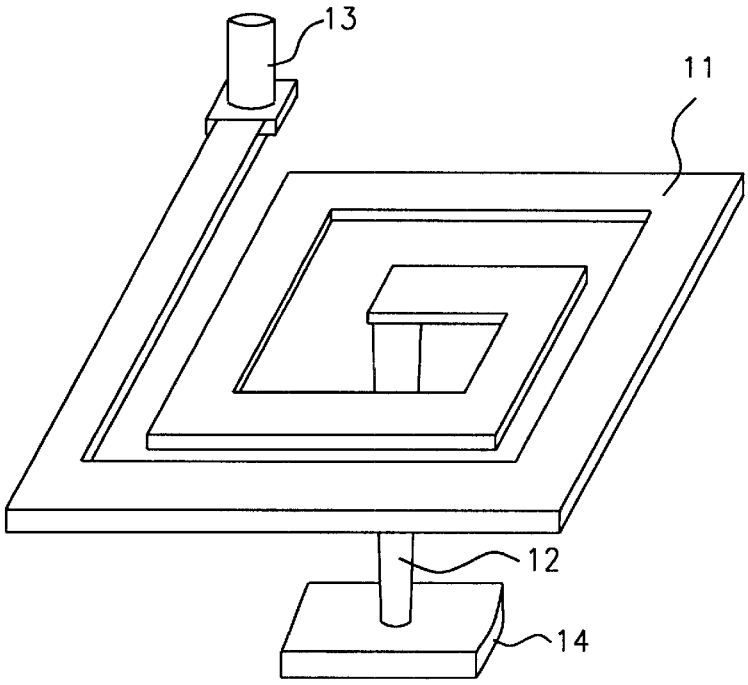
FIG. 1b – Prior Art

HIGH EFFICIENCY THIN FILM INDUCTOR

This is a divisional of patent application Ser. No. 09/359,892, filing date Jul. 26, 1999, now U.S. Pat. No. 6,278,352, High Efficiency Thin Film Inductor, assigned to the same assignee as the present invention.

FIELD OF THE INVENTION

The invention relates to the general field of integrated circuit manufacture with particular reference to thin film inductors.

BACKGROUND OF THE INVENTION

In the manufacture of integrated circuits incorporation of inductors (as opposed to capacitors) has generally been avoided because of the difficulty of fabricating them. Inductors are generally thought of as three-dimensional objects hence their unsuitability for integrated circuits. However, the basic formula for calculating the inductance value L of a particular coiled geometry is $$L=(\mu N^2 A)/s$$

where N is the number of turns in the coil, A is the mean cross-sectional area of the coil, s is the length of the coil, and $\mu$ is the magnetic permeability of the medium in which the coil is immersed.

In the macro world, inductors are usually formed by winding wire around a cylinder of fixed radius, thereby guaranteeing fixed cross-sectional area. More than one layer of wire turns are generally used, thereby increasing the value of N while keeping the value of s low. Instead of a cylindrical geometry a spiral such as shown in FIG. 1*a* may be used. Spiral 11 is wound in a plane and has an inner starting point 12 and an outer ending point 13 both of which being used to contact the spiral (see example of lower level wiring 14 which appears in FIG. 1*b* which is an isometric view of FIG. 1*a*). However, the effective cross-sectional area (for determining an inductance value) of such a spiral will be less than the actual cross-sectional area of the full spiral. This is offset to some extent by the fact that the length(s) of the spiral coil is significantly reduced relative to that of a cylindrical coil, even allowing for edge effects.

Thus, spiral inductors have proven popular for use in integrated circuits even though the magnetic permeability $\mu$ of the medium in which the coil is immersed is unity. In a macro coil of cylindrical design, $\mu$ can be increased to a much higher value than that of air by inserting a core of a material such as soft iron in the interior of the cylinder, said core having a diameter only slightly less than that of the coil itself.

Another factor in thin film inductor design that needs to be mentioned is that, because of the close proximity of all the components to one another, stray lines of magnetic flux associated with the inductor can have an effect (mutual inductance) on nearby components and devices. This is often hard to predict and unexpected side effects associated with inductors in integrated circuits are an ongoing problem.

A routine search of the prior art was conducted but, as far as we have been able to determine, no attempts have been made in the prior art to increase the permeability associated with a thin film inductor or to reduce unexpected proximity effects. For example, Abidi et al. (U.S. Pat. No. 5,539,241) describe a thin film inductor which is formed in a manner such that it is suspended over a pit in the substrate. This reduces parasitic capacitance thereby raising the self resonant frequency of the inductor.

Lue (U.S. Pat. No. 5,863,806) describes how an inductive coil that is three dimensional and therefore occupies less area, maybe formed.

Desaigoudar et al. (U.S. Pat. No. 5,370,766) show how a thin film inductor may be formed as a byproduct of other process steps so that the additional cost of having an inductor in the circuit is reduced to a minimum. Desaigoudar et al. (U.S. Pat. No. 5,450,263) is a divisional of the previous patent, claiming the structure.

SUMMARY OF THE INVENTION

It has been an object of the present invention to provide a thin film inductor having high inductance per unit area.

Another object of the invention has been to increase the magnetic permeability of the medium in which a thin film inductor is immersed.

Still another object of the invention has been to provide a low reluctance path for the magnetic flux associated with said inductor, thereby reducing inductive effects on neighboring components and devices during circuit operation.

These objects have been achieved by adding to a spiral inductor a core of high permeability material located at the center of the spiral. If the high permeability material is a conductor care must be taken to avoid any contact between the core and the spiral. If a dielectric ferromagnetic material is used, this constraint is removed from the design. Several other embodiments are shown in which, in addition to the high permeability core, low reluctance paths have been added to the structure. In one case this takes the form of a frame of ferromagnetic material surrounding the spiral while in a second case it has the form of a hollow square located directly above the spiral.

BRIEF DESCRIPTION OF THE DRAWINGS

FIG. 1*a* shows a typical spiral design inductor coil of the prior art.

FIG. 1*b* is an isometric view of FIG. 1*a*.

DESCRIPTION OF THE PREFERRED EMBODIMENTS

We will describe three different structures that can be used to achieve improved inductance values (per unit area of real estate on a chip). All the structures teach the use of substructures made of ferromagnetic material that serve to provide a low reluctance path for the magnetic flux of the basic inductor coil. Each of these structures may be implemented using a conductive ferromagnetic material (such as iron, nickel, cobalt, or any of the many known magnetic alloys) or a dielectric ferromagnetic material (such as one of the ferrite family, chromium dioxide, etc., making a total of six embodiments of the invention that we will describe. It will be understood that similar flux concentrators implemented in thin film technology may be devised without departing from the spirit of the invention.

First Embodiment

Figure 2A:
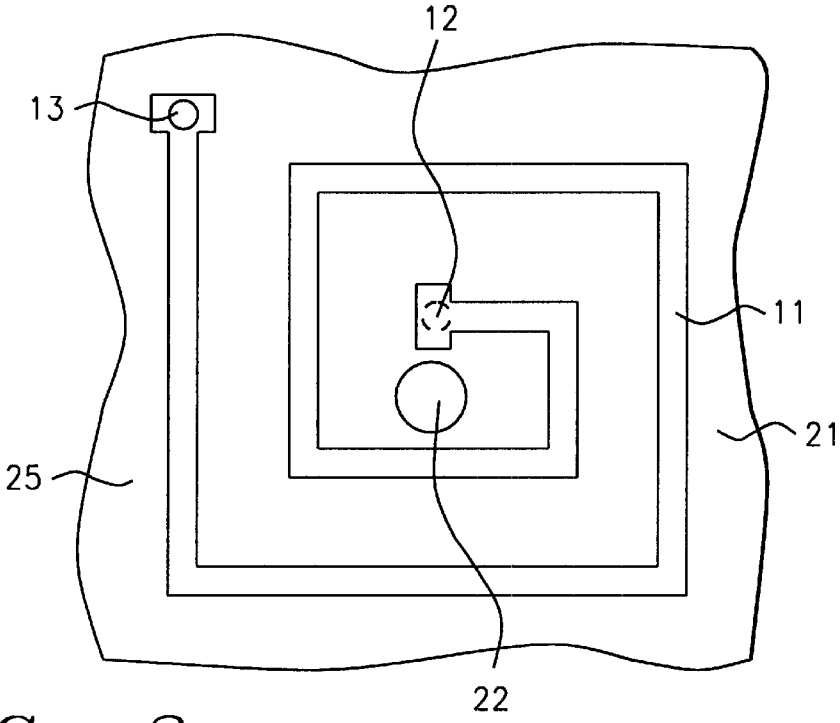
FIGS. 2*a* and 2*b* show a first embodiment of the present invention illustrating how a high a permeability core can be added to the structure.

Referring now to FIG. 2*a*, a thin film inductor 11 in the form of a wire spiral is seen in plan view. The spiral lies on dielectric layer 21 which will, in general, be one of the layers that make up an integrated circuit. The number of turns of the spiral is between 1 and about $10^5$. The spiral has been formed from a conductive metal such as aluminum or copper and has a rectangular cross-section that is between about 10 and $10^6$ Angstroms high and between about 0.5 and 50 microns wide. It may have been patterned and etched from a deposited layer or it may have been created by filling in pre-formed trenches in the surface of layer 21 (damascene wiring).

A second dielectric layer (which is not shown in the diagram) covers spiral 11. To. make contact to the inductor (spiral 11), two conductive plugs have been formed. The first of these is conductive plug 12 which extends downwards from the inner end of the spiral, through dielectric layer 11, extending as far as the next wiring level below the spiral. The second conductive plug 13 extends upwards from the outer end of the spiral, through the second dielectric layer, continuing upwards as far as needed to contact the wiring at that level.

A key feature of the invention is core plug 22 which is located adjacent to plug 12 and is formed from ferromagnetic material. It extends upwards from the surface of layer 21 (through the second dielectric layer) as well as downwards through layer 21 and beyond. The diameter of this core. plug is between about 0.1 and 5 microns while it is typically between about 0.5 and 5 microns in length. For this embodiment the core plug may be made from either conductive or insulating ferromagnetic material so care must be taken to ensure that it does not contact the spiral at any point.

Figure 2B:
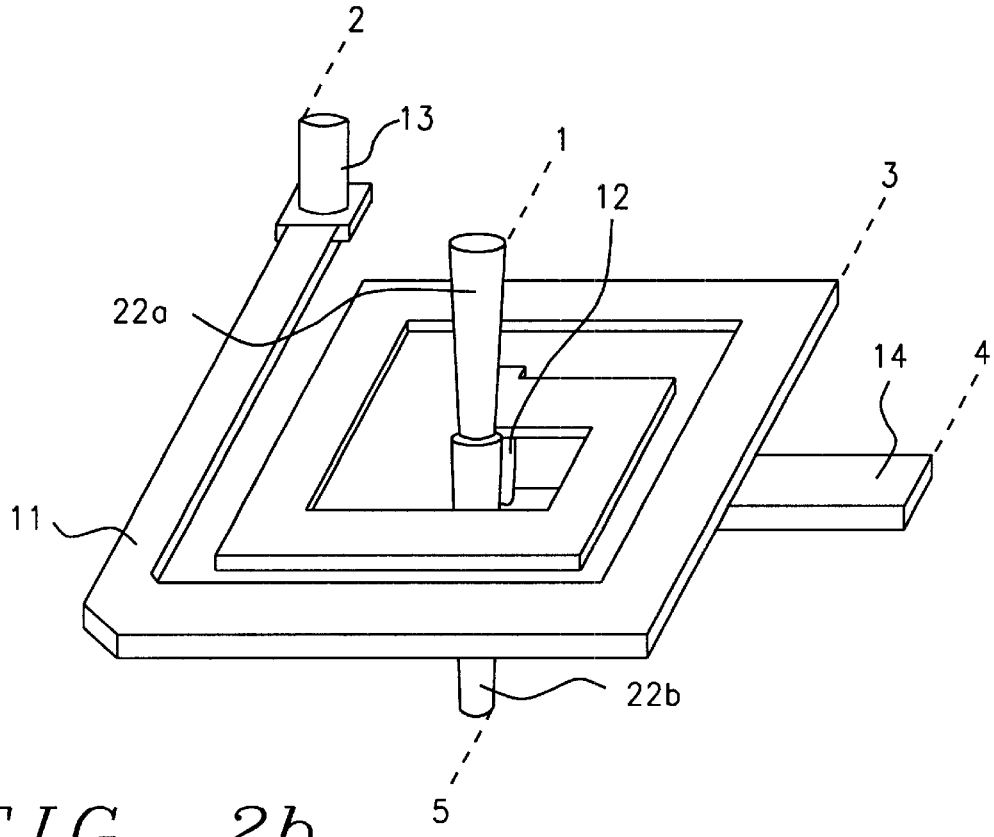

An isometric view of the plan shown in FIG. 2*a* is shown in FIG. 2*b*. As an aid to visualizing the stricture different levels within it have been indicated through the broken lines labeled 1 through 5 with 1 representing the highest level and 5 the lowest. Note conductive line 14 to which plug 12 has made contact.

Second Embodiment

We refer again to FIG. 2*a*. As in the first embodiment, conductive spiral 11 lies on dielectric layer or substrate 11. The number of turns of the spiral is between 1 and about $10^5$. The spiral has been formed from a conductive metal such as aluminum or copper and has a rectangular cross-section that is between about 10 and $10^6$ Angstroms high and between about 0.5 and 50 microns wide. It may have been patterned and etched from a deposited layer or it may have been created by filling in pre-formed trenches in the surface of layer 21 (damascene wiring).

To make contact to the inductor (spiral 11), two conductive plugs have been formed. The first of these is conductive plug 12 which extends downwards from the inner end of the spiral to the next wiring level below the spiral. The second conductive plug 13 extends upwards from the outer end of the spiral continuing upwards as far as needed to contact the wiring at that level.

As in the first embodiment, a key feature of the invention is core plug 22 which is located adjacent to plug 12 and is formed from ferromagnetic material. It extends upwards from the surface of layer 21 as well as downwards. The diameter of this core plug is between about 0.1 and 5 microns while it is typically between about 0.5 and 5 microns in length. For this embodiment the core plug is restricted to being of a dielectric (as well as ferromagnetic) material so it may be located at any point close to the center of the spiral with no concern as to whether or not it contacts any point on the spiral. This also allows it to have a greater diameter than its equivalent in the first embodiment should the designer choose to do so.

As for the first embodiment, an isometric view of the plan shown in FIG. 2*a* is seen in FIG. 2*b*. As an aid to visualizing the structure different levels within it have been indicated through the broken lines labeled 1 through 5 with 1 representing the highest level and 5 the lowest. Note conductive line 14 to which plug 12 has made contact.

Third Embodiment

Figure 3A:
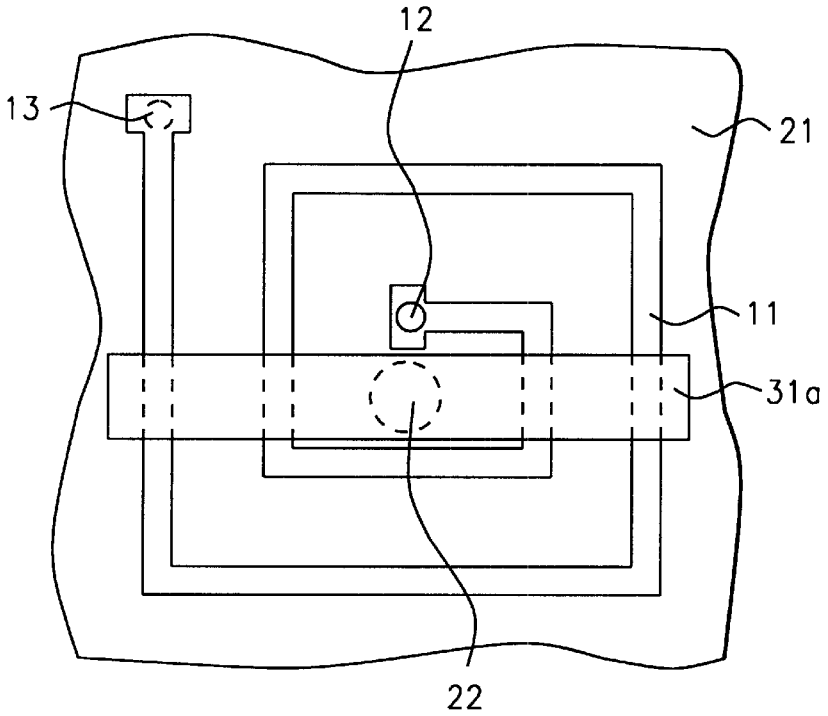
FIGS. 3*a* and 3*b* show another embodiment in which the structure of FIG. 2 is further enhanced by adding a low reluctance magnetic path.
Figure 3B:
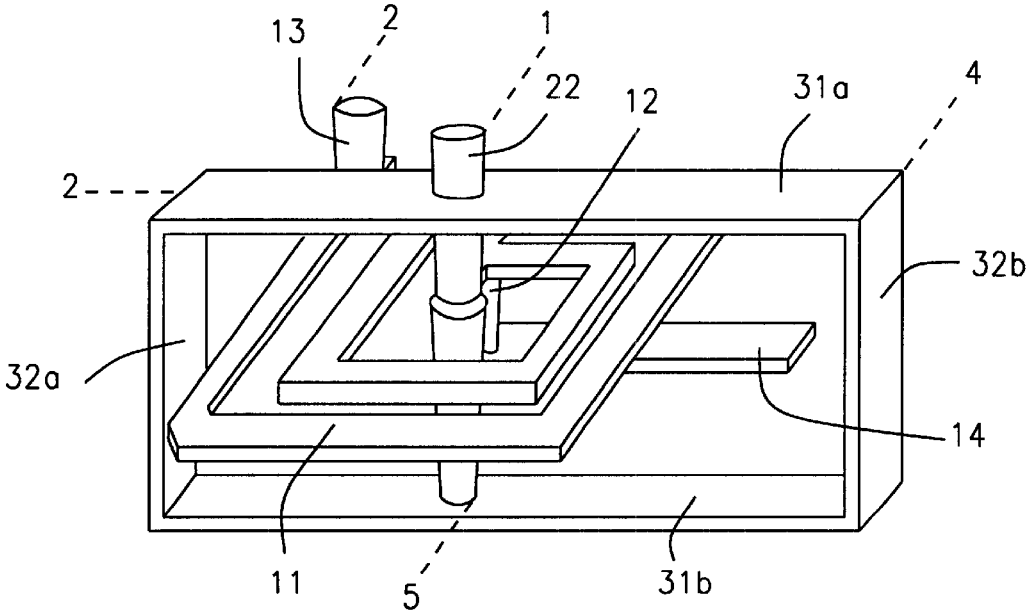

We refer now to FIGS. 3*a* and 3*b*. Part of this structure is the same as what was shown in the first embodiment. That is a thin film inductor 11 in the form of a wire spiral lies on dielectric layer 21 which will, in general, be one of the layers that make up an integrated circuit. The number of turns of the spiral is between 1 and about $10^5$. The spiral has been formed from a conductive metal such as aluminum or copper and has a rectangular cross-section that is between about 10 and $10^6$ Angstroms high and between about 0.5 and 50 microns wide. It may have been patterned and etched from a deposited layer or it may have been created by filling in pre-formed trenches in the surface of layer 21 (damascene wiring).

A second dielectric layer (which is not shown in the diagram) covers spiral 11. To make contact to the inductor (spiral 11), two conductive plugs have been formed. The first of these is conductive plug 12 which extends downwards from the inner end of the spiral,. through dielectric layer 11, extending as far as the next wiring level below the spiral. The second conductive plug 13 extends upwards from the outer end of the spiral, through the second dielectric layer, continuing upwards as far as needed to contact the wiring at that level.

As before, one key feature of this embodiment is core plug 22 which is located adjacent to plug 12 and is formed from ferromagnetic material. It extends upwards from the surface of layer 21 (through the second dielectric layer) as well as downwards through layer 21 and beyond. The diameter of this core plug is between about 0.1 and 5 microns while it is typically between about 0.5 and 5 microns in length. For this embodiment the core plug may be made from either conductive or insulating ferromagnetic material so care must be taken to ensure that it does not contact the spiral at any point.

An additional feature of this embodiment is a frame of ferromagnetic material (seen as 31*a* in FIG. 3*a*) that surrounds the spiral. This can be more clearly sen in FIG. 3*b* which shows that the frame is made up of four rectangularly shaped parts. These are horizontal parts 31*a* and 31*b* (having a rectangular cross-section that is between about 10 and $10^6$ Angstroms high and between about 0.5 and 50 microns wide) and vertical parts 32*a* and 32*b* (having a rectangular cross-section that is between about 0.5 and 5 microns long and between about 0.5 and 5 microns wide). These four parts all connect to one another at their edges and together form a frame which is large enough to fully overlap the spiral. This provides a low reluctance path for the magnetic flux lines of the inductor, thereby increasing its inductance value.

Since, for this embodiment, the ferromagnetic material that is used includes conductors, care must be taken to ensure that frame 31/32 and core plug 22 do not make contact at any point with spiral 11.

Fourth Embodiment

This embodiment is the same as the just described third embodiment except that the ferromagnetic material that is used is limited to dielectric ferromagnetic materials. As a consequence, the limitation imposed on the third embodiment that frame 31/32 and, core plug 22 do not make contact at any point with spiral 11 is no longer present. As a result, there is more freedom available to a designer in choosing the dimensions of the various parts of the structure. Thus, for this embodiment, the diameter of core plug 22 is between about 0.1 and 5 microns while it is typically between about 0.5 and 5 microns in length.

Similarly, for frame 31/32, the horizontal parts 31*a* and 31*b* have a rectangular cross-section that is between about 10 and $10^6$ Angstroms high and between about 0.5 and 50 microns wide while the vertical parts 32*a* and 32*b* have a rectangular cross-section that is between about 0.5 and 5 microns long and between about 0.5 and 5 microns wide. Additionally, there is no requirement that a dielectric layer (such as the second dielectric layer of the third embodiment) be interposed between the ferromagnetic layer and spiral 11.

Fifth Embodiment

Figure 4A:
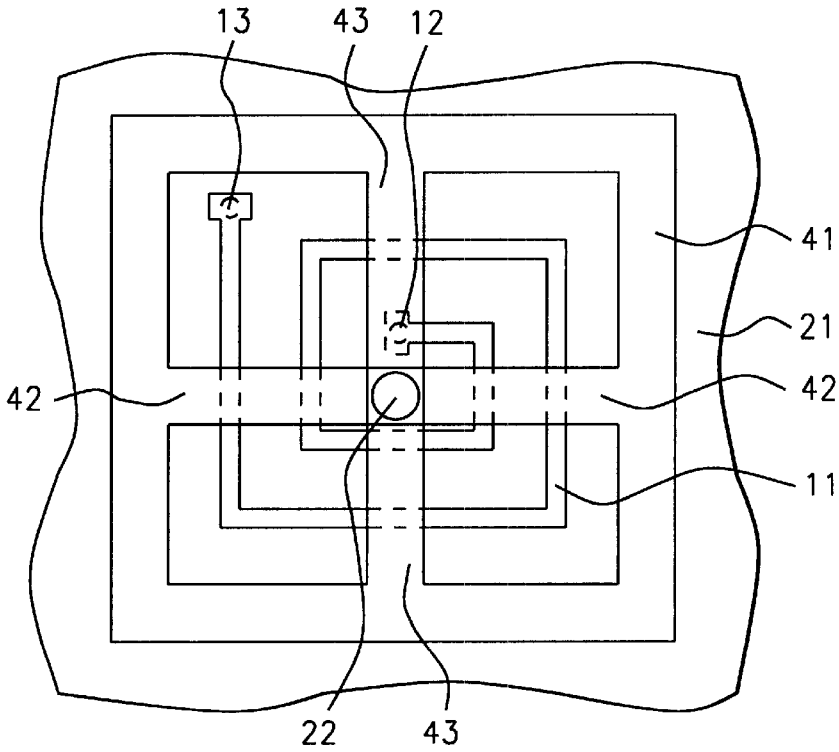
FIGS. 4*a* and 4*b* show still another embodiment of the structure of FIG. 2 after enhancement by a different design of low reluctance magnetic path.
Figure 4B:
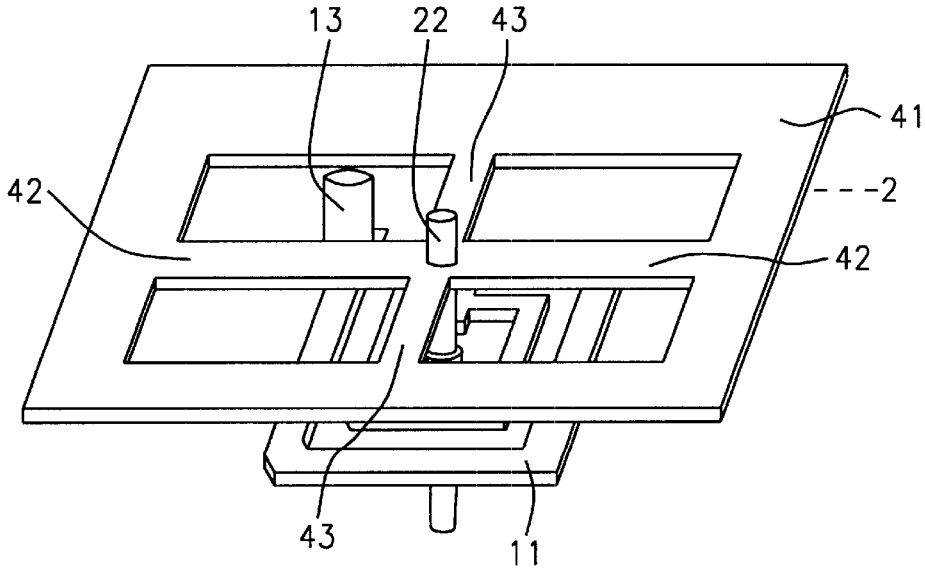

We refer now to FIGS. 4*a* and 4*b*. Part of this structure is also the same as what was shown in the first embodiment. That is a thin film inductor 11 in the form of a wire spiral lies on dielectric layer 21 which will, in general, be one of the layers that make up an integrated circuit. The spiral has been formed from a conductive metal such as aluminum or copper and has a rectangular cross-section that is between about 10 and $10^6$Angstroms high and between about 0.5 and 50 microns wide. It may have been patterned and etched from a deposited layer or it may have been created by filling in pre-formed trenches in the surface of layer 21 (damascene wiring).

A second dielectric layer (which is not shown in the diagram) covers spiral 11. To make contact to the inductor (spiral 11), two conductive plugs have been formed. The first of these is conductive plug 12 which extends downwards from the inner end of the spiral, through dielectric layer 11, extending as far as the next wiring level below the spiral. The. second conductive plug 13 extends upwards from the outer end of the spiral, through the second dielectric layer, continuing upwards as far as needed to contact the wiring at that level.

As before, one key feature of this embodiment is core plug 22 which is located adjacent to plug 12 and is formed from ferromagnetic material. It extends upwards from the surface of layer 21 (through the second dielectric layer) as well as downwards through layer 21 and beyond. The diameter of this core plug is between about 0.1 and 5 microns while it is typically between about 0.5 and 5 microns in length. For this embodiment the core plug may be made from either conductive or insulating ferromagnetic material so care must be taken to ensure that it does not contact the spiral at any point.

An additional feature of this embodiment is hollow square 41 which has core plug 22 at its center. Connecting opposing inner edges of the hollow square at their centers are cross members 42 and 43. This can also be seen in FIG. 4*b* which is an isometric view of FIG. 4*a*. These parts, 41, 42, and 43, have a rectangular cross-section that is between about 10 and $10^6$ Angstroms high and between about 0.5 and 50 microns wide. This provides a low reluctance path for the magnetic flux lines of the inductor, thereby increasing its inductance value.

Since, for this embodiment, the ferromagnetic material that is used includes conductors, care must be taken to ensure that the parts 41/42/43 and core plug 22 do not make contact at any point with spiral 11.

Sixth Embodiment

This embodiment is the same as the just described fifth embodiment except that the ferromagnetic material that is used is limited to dielectric ferromagnetic materials. As a consequence, the limitation imposed on the third embodiment that parts 41/42/43 and core plug 22 do not make contact at any point with spiral 11 is no longer present. As a result, there is more freedom available to a designer in choosing the dimensions of the various parts of the structure. Thus, for this embodiment, the diameter of core plug 22 is between about 0.1 and 5 microns while it is typically. between about 0.5 and 5 microns in length.

As in the fourth embodiment, parts 41/42/43 have a rectangular cross-section that is between about 10 and $10^6$Angstroms high and between about 0.5 and 50 microns wide while the vertical parts 32*a* and 32*b* have a rectangular cross-section that is between about 0.5 and 50 microns long and between about 0.5 and 50 microns wide. Additionally, there is no requirement that a dielectric layer (such as the second dielectric layer of the fifth embodiment) be interposed between the ferromagnetic layer and spiral 11.

While the invention has been particularly shown and described with reference to the preferred embodiments thereof, it will be understood by those skilled in the art that various changes in form and details may be made without departing from the spirit and scope of the invention.

What is claimed is:

1. A thin film inductor, comprising:

a first dielectric layer;

on the first dielectric layer, a thin film conductor having the shape of a wire spiral that has a number of turns, said spiral having an inner end that is a starting point of the spiral and an outer end that is an ending point of the spiral;

a second dielectric layer over the wire spiral;

a first conductive plug extending downwards from said inner end through the first dielectric layer and projecting below it;

a second conductive plug extending upwards from said outer end through the second dielectric and projecting above it;

adjacent to the first conductive plug, a core plug of a ferromagnetic material that extends upwards through the second dielectric layer and downwards through the first dielectric layer, the core plug not contacting the spiral at any point;

a frame of ferromagnetic material that surrounds the spiral and that further comprises:

on the second dielectric layer, a first rectangular horizontal part extending outwards from said ferromagnetic plug for a distance sufficient for its outer, edges to fully overlap the spiral;

below the first dielectric layer, a second rectangular horizontal part exactly underlying said first rectangular part; and two rectangular vertical parts extending downwards through said first and second dielectric layers and connecting the first and second horizontal parts at their outer edges, thereby providing a low reluctance path that increases the inductance of the inductor.

2. The inductor described in claim 1 wherein the number of turns is between 1 and about $10^5$.

3. The inductor described in claim 1 wherein said Wire has a rectangular cross-section that is between about 10 and $10^6$ Angstroms high and between about 0.5 and 50 microns wide.

4. The inductor described in claim 1 wherein said rectangular horizontal parts have a rectangular cross-section that is between about 10 and $10^6$ Angstroms high and between about 0.5 and 50 microns wide.

5. The inductor described in claim 1 wherein said rectangular vertical parts have a rectangular cross-section that is between about 0.5 and 50 microns long and between about 0.5 and 50 microns wide.

6. A thin film inductor, comprising:

an insulating substrate;

on the substrate, a thin film conductor having the shape of a wire spiral, said spiral having an inner end that is a starting point of the spiral and an outer end that is an ending point of the spiral;

adjacent to the inner end, a core plug, having a diameter between about 0.1 and 1 microns, of a ferromagnetic material that is also a dielectric and that extends in both upward and downward directions;

a first conductive plug extending downwards from said inner end;

a second conductive plug extending upwards from said outer end;

a frame of a ferromagnetic material that is also a dielectric that surrounds the spiral and that further comprises:

on the substrate and the spiral, a first rectangular horizontal part extending outwards from said dielectric ferromagnetic plug for a distance sufficient for its outer edges to fully overlap the spiral;

below the spiral, a second rectangular horizontal part exactly underlying said first rectangular part; and two rectangular vertical parts extending downwards thereby connecting the first and second horizontal parts at their outer edges, thereby providing a low reluctance path that increases the inductance of the inductor.

* * * * *